US011845526B2

(12) United States Patent
Floyd et al.

(10) Patent No.: US 11,845,526 B2
(45) Date of Patent: Dec. 19, 2023

(54) RAW WATER ISOLATOR FOR WATERCRAFT

(71) Applicant: F&S Yachts, LLC, Bear, DE (US)

(72) Inventors: John Floyd, Bear, DE (US); Todd August, Bear, DE (US)

(73) Assignee: F & S Yachts, LLC, Bear, DE (US)

( * ) Notice: Subject to any disclaimer, the term of this patent is extended or adjusted under 35 U.S.C. 154(b) by 0 days.

(21) Appl. No.: 17/823,284

(22) Filed: Aug. 30, 2022

(65) Prior Publication Data

US 2023/0066974 A1 Mar. 2, 2023

Related U.S. Application Data

(60) Provisional application No. 63/239,109, filed on Aug. 31, 2021.

(51) Int. Cl.
*B63J 2/14* (2006.01)
*B63B 25/14* (2006.01)

(52) U.S. Cl.
CPC ..... *B63J 2/14* (2013.01); *B63B 25/14* (2013.01)

(58) Field of Classification Search
CPC .. F24H 1/188; F24D 3/1008; B63J 2002/005; B63J 2/12; B63J 2/14; F24F 2005/0025
See application file for complete search history.

(56) References Cited

FOREIGN PATENT DOCUMENTS

| | | | | |
|---|---|---|---|---|
| GB | 2413623 A | * | 11/2005 | ..... F04F 5/04 |
| KR | 20090112079 A | * | 10/2009 | |
| KR | 20110054546 A | * | 5/2011 | |

OTHER PUBLICATIONS

KR20110054546A Translation (Year: 2011).*
KR20090112079A Translation (Year: 2009).*

* cited by examiner

*Primary Examiner* — Schyler S Sanks
(74) *Attorney, Agent, or Firm* — McHale & Slavin, P.A.

(57) ABSTRACT

A raw water isolator for watercraft for providing treated fluid to loop of air conditioning units, freezers, ice makers, gyro stabilizers and the like systems. The raw water isolator provides a closed loop of treated fluid to prevent such systems from exposure to raw water known to contain biological material capable of fouling the units, and associated corrosion when salt water is used for the cooling mechanism. The apparatus employs a storage and expansion tank for holding a volume of fluid that is circulated through the marine units. A heat exchanger selected for ease of cleaning provides heat transfer between the cooling fluid and raw water.

12 Claims, 8 Drawing Sheets

RAW WATER ISOLATOR FOR WATERCRAFT

CROSS REFERENCE TO RELATED APPLICATIONS

In accordance with 37 C.F.R. § 1.76, a claim of priority is included in an Application Data Sheet filed concurrently herewith. Accordingly, the present invention claims priority to U.S. Provisional Patent Application No. 63/239,109 entitled "RAW WATER ISOLATOR FOR WATERCRAFT", filed Aug. 31, 2021. The contents of which the above referenced application is incorporated herein by reference.

FIELD OF THE INVENTION

The field of the invention is watercraft, and in particular, to an apparatus for isolating raw water from marine air conditioners and the like conventional systems that are cooled with raw water.

BACKGROUND OF THE INVENTION

Watercraft, in this specification, is used interchangeably with boat, yacht, vessel and the like watercraft terms. Such watercraft employ a variety of systems that utilize raw water for cooling; raw water being defined as the water found external the hull of the watercraft. Conventional watercraft draw raw water through a seacock wherein the water is used for cooling air conditioners, gyro stabilizers, ice makers, chillers, generators, propulsion engines, and so forth. Of particular interest is the cooling of air conditioners ("AC") by use of raw water. The compactness of AC compressors, versus land based AC compressors, is made possible by cooling the compressors by an unlimited supply of raw water without the necessity of blower fans. Unfortunately, raw water cooling systems can quickly become impaired upon the colonization of slime, algae, mussels, or other molluscicides in fresh water; or barnacles, sea worms or other biological matter in salt water. In either environment, fouling within the AC units impairs the heat transfer required for proper operation. This is troublesome as the organisms grow inside the cooling systems, making it difficult to determine the extent of fouling until the effectiveness of an AC is lost. This can lead to uncomfortable conditions for guests, and loss of refrigeration should ice makers, chillers, gyros and other water cooled devices become fouled. Excessive growth commonly referred to as slime, can act like an insulating blanket which not only impairs heat transfer, but also the flow of water.

Organisms such as barnacles thrive within raw water systems as the constant flow of water delivers a well oxygenated environment that barnacle clusters thrive upon. Because AC units are operated while a vessel is docked and while cruising, the growth within the AC cooling system is uninhibited. In addition, bacteria found in raw water can accelerate corrosion, leading to pitting and even failure of metal alloy welds.

While the use of an unlimited supply of raw water allows marine AC units to be relatively compact, their output capacity is limited. For this reason, it is typical to equip watercraft with multiple AC units. For example, a 60' boat may have five different zones, each treated with an independent AC unit. Such a watercraft may have an AC unit for chilling a salon, a master stateroom, a VIP stateroom, a helm area, captain's quarters, and so forth. An advantage exists in having multiple AC units; wherein if one AC unit fails, guests on the vessel can still enjoy the treated air provided by the remaining operating AC units. Obviously, more AC units can be used to treat the internal space of larger vessels. Also, it is not uncommon for watercraft to use raw water cooling for freeze boxes and ice maker compressors. Many vessels enjoy the use of large gyroscopic stabilizers which require cooling. This multitude of units all require maintenance if designed heat transfer is to take place. The clogging of one or more AC units or other raw water cooled systems can be an inconvenience at best, and lead to severe damage if the units are allowed to overheat.

While marine organism growth can be discouraged by use of antifouling paints, it is not possible to coat the inside of AC units, compressors, generators, chillers or other units that utilize heat transfer from raw water. For this reason, the maintenance of such systems is typically performed by periodically introducing various buffered acids into the cooling system for dissolving of the growth. Such acids are expensive and typically need additional equipment for recirculation of the acids. Since multiple units may need to be individually treated, the units may need to be isolated, making the cleaning complicated and time consuming. Acids can be harmful to the metals used in the cooling systems, as well as to the environment upon disposal. It is not uncommon for maintenance personnel to use strong acid in an effort to quickly remove growth. Strong acids can quickly etch the metals used for heat transfer leading to leaks and early failure.

Further, galvanic corrosion is commonly found in salt water cooled system. Galvanic corrosion is an electrochemical reaction that causes electrons to flow from one metal to another. For instance, dissimilar metals such as aluminum and bronze can cause electrolyte corrosion, as the salt water is an excellent carrier of stray currents. A stray current can be received from something as simple as an improperly grounded bilge pump, to something more complex, such as when stray currents are caused by a marine vessel docked nearby. With the possibility of galvanic corrosion, modern AC systems use more expensive materials to help resist early failure due to corrosion.

AC units require high amperage for operation. Due to the high probability of fouling, designers typically specify larger units to compensate for anticipated heat exchanger inefficiency. The over-sizing of such units has a ripple effect, wherein the larger units draw higher amperage which can require larger current demands. For this reason, a vessel may require larger power cords and will be charged a higher dockage rate based on what the vessel is connected to. The internal boat wiring would need to be enlarged for the bigger marine AC units, and larger generators will be needed for use while the vessel is cruising or if the shore power is inadequate.

What is lacking in the industry is a system to provide treated fluid to marine AC systems, and the like raw water cooled systems, thereby prolonging the life of such systems and reducing maintenance and operational issues.

SUMMARY OF THE INVENTION

Disclosed is a raw water isolator apparatus for watercraft. The apparatus provides cooling fluid to marine AC units, freezers, ice makers, gyro stabilizers, generators and the like systems found on watercraft. A closed loop of treated cooling fluid replaces the raw water used for the above captioned systems, which prevents the marine units from exposure to raw water fouling and associated metal corrosion. A central tank coupled to an expansion tank holds a volume of cooling fluid that is circulated through the marine units; the fluid absorbing the excess heat by the marine units for circulation through a heat exchanger designed to be cooled with raw water. The heat exchanger is constructed and arranged to allow ease of cleaning.

An objective of the invention is to eliminate marine AC units and other devices cooled with raw water from fouling, required cleanings, and corrosion.

Still another objective of the invention is to prevent barnacle growth, slime, or the like organism growth, within marine AC units.

Another objective of the invention is to maintain a high level of heat transfer efficiency in marine AC units.

Yet still another objective of the invention is to teach the use of a marine AC unit isolator to allow engineers to calculate a desired BTU output for a zone without the need to compensate for fouling, thereby allowing for small units and lower electrical requirements.

Another objective of the invention is to eliminate the maintenance expense on marine AC units, such as acid cleanouts, which can hasten dissimilar metal corrosion, and the associated disposal of the cleanout material. Further, the invention allows the use of less costly material selections on the marine AC units.

Still another objective of the invention is to eliminate marine freezers, ice boxes, chillers, ice makers, gyroscopic units, generators, and the like raw water cooled units from fouling, required cleanings, and corrosion.

Other objectives, advantages and benefits associated with this invention will be apparent to those skilled in the art from the description, examples and the claims which follow.

DETAILED DESCRIPTION OF THE PREFERRED EMBODIMENT

Figure 1:
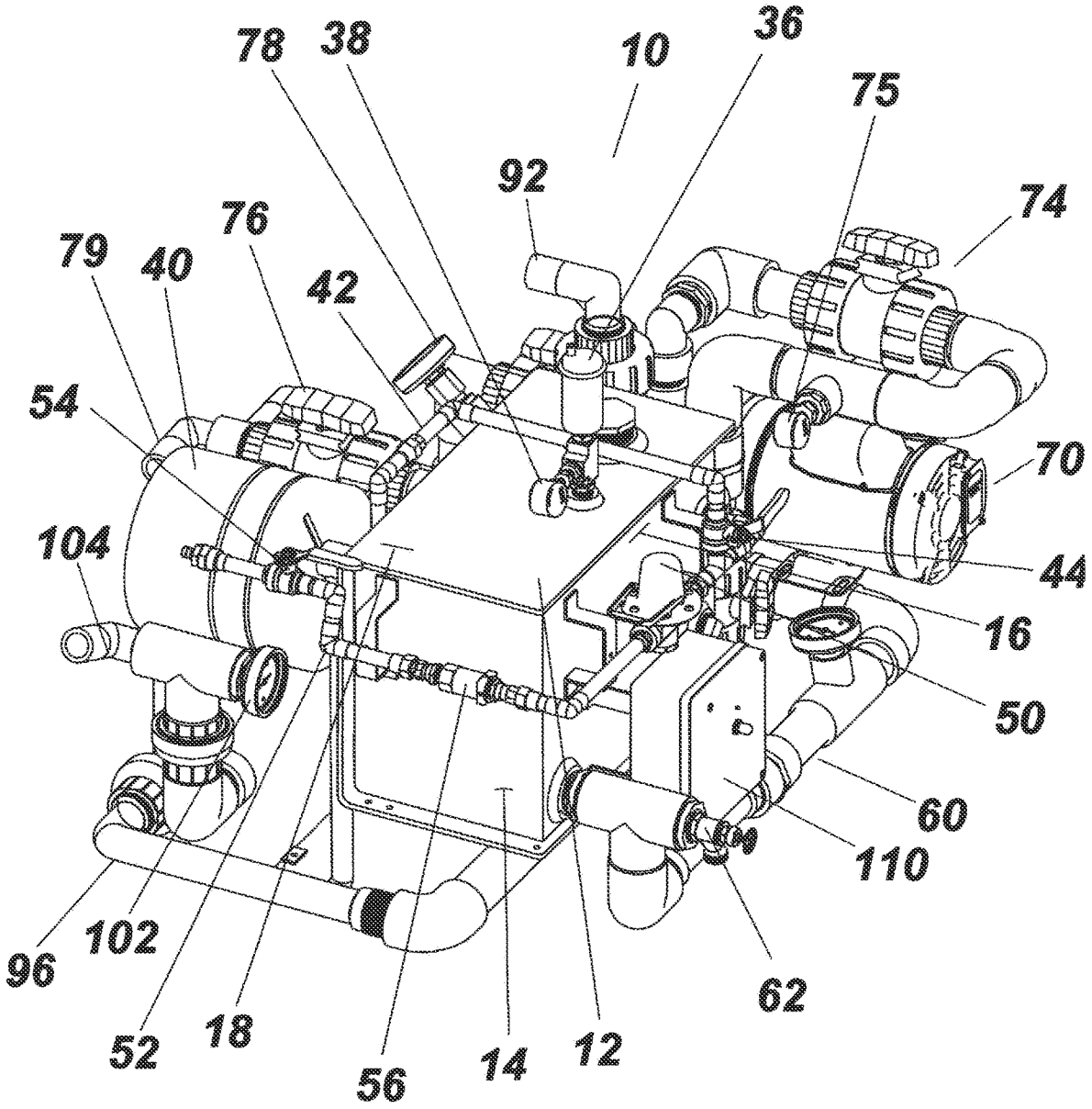
FIG. 1 is a front left perspective of the raw water isolator for watercraft.
Figure 2:
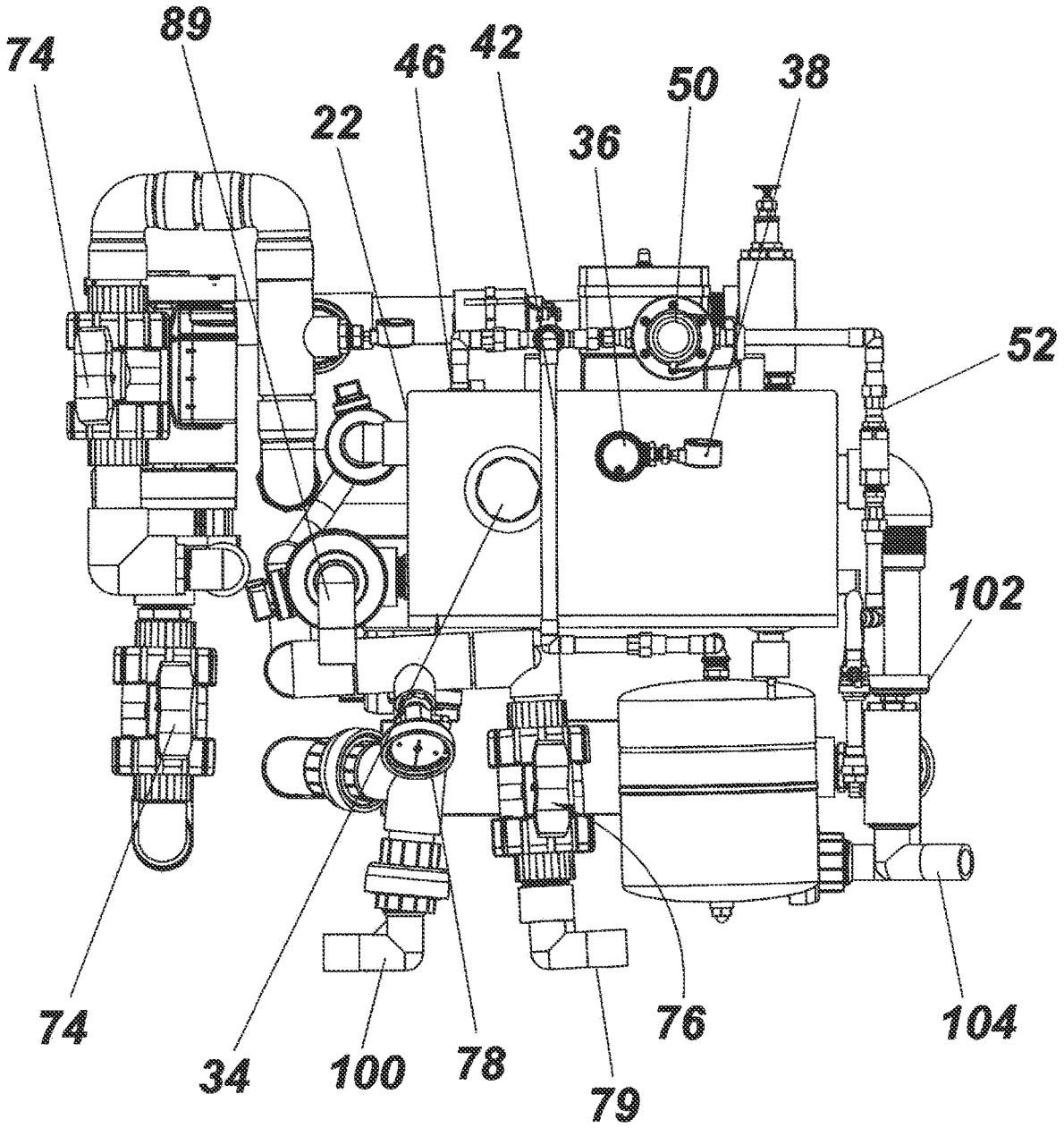
FIG. 2 is a top view thereof.
Figure 3:
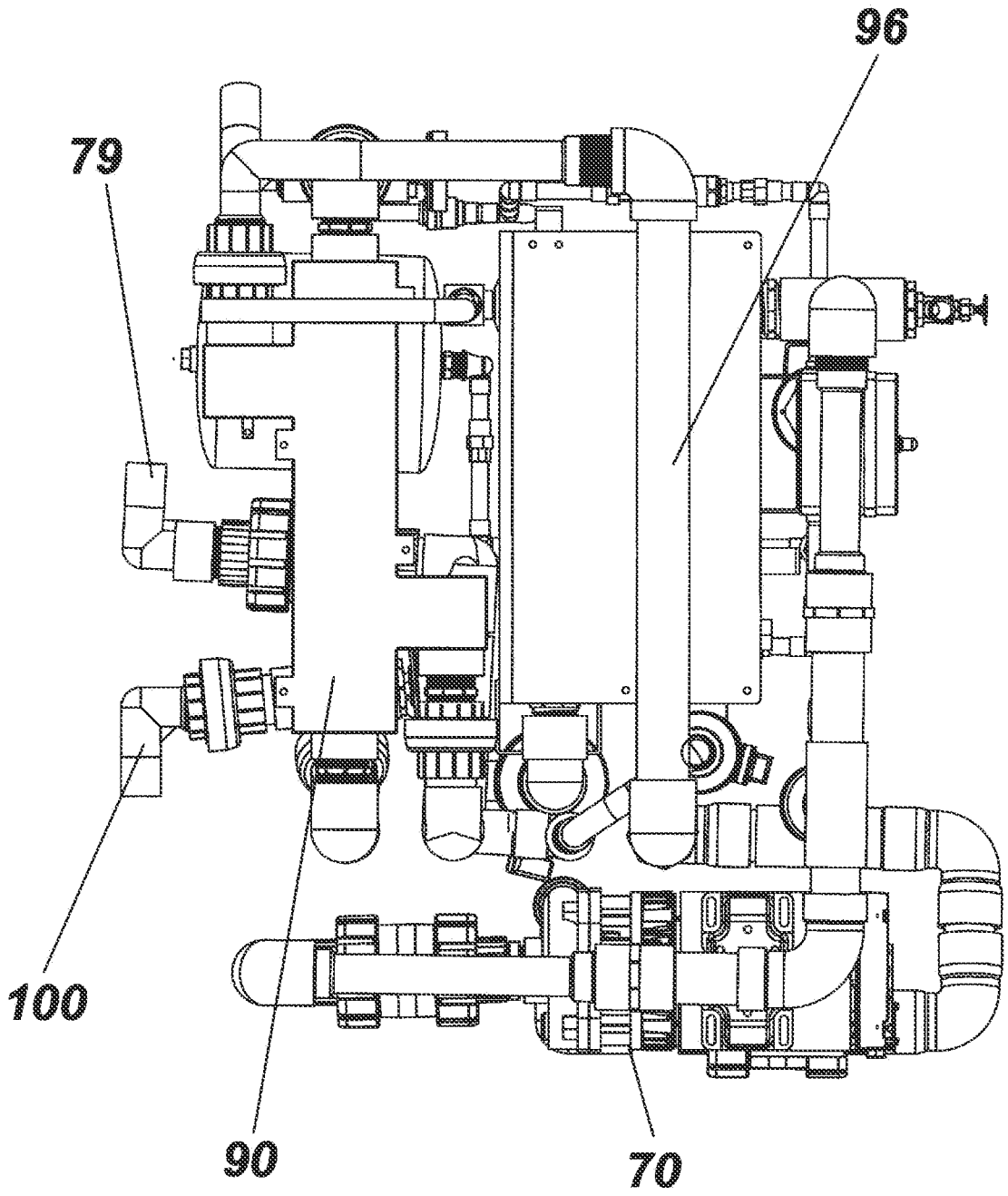
FIG. 3 is a bottom view thereof.
Figure 4:
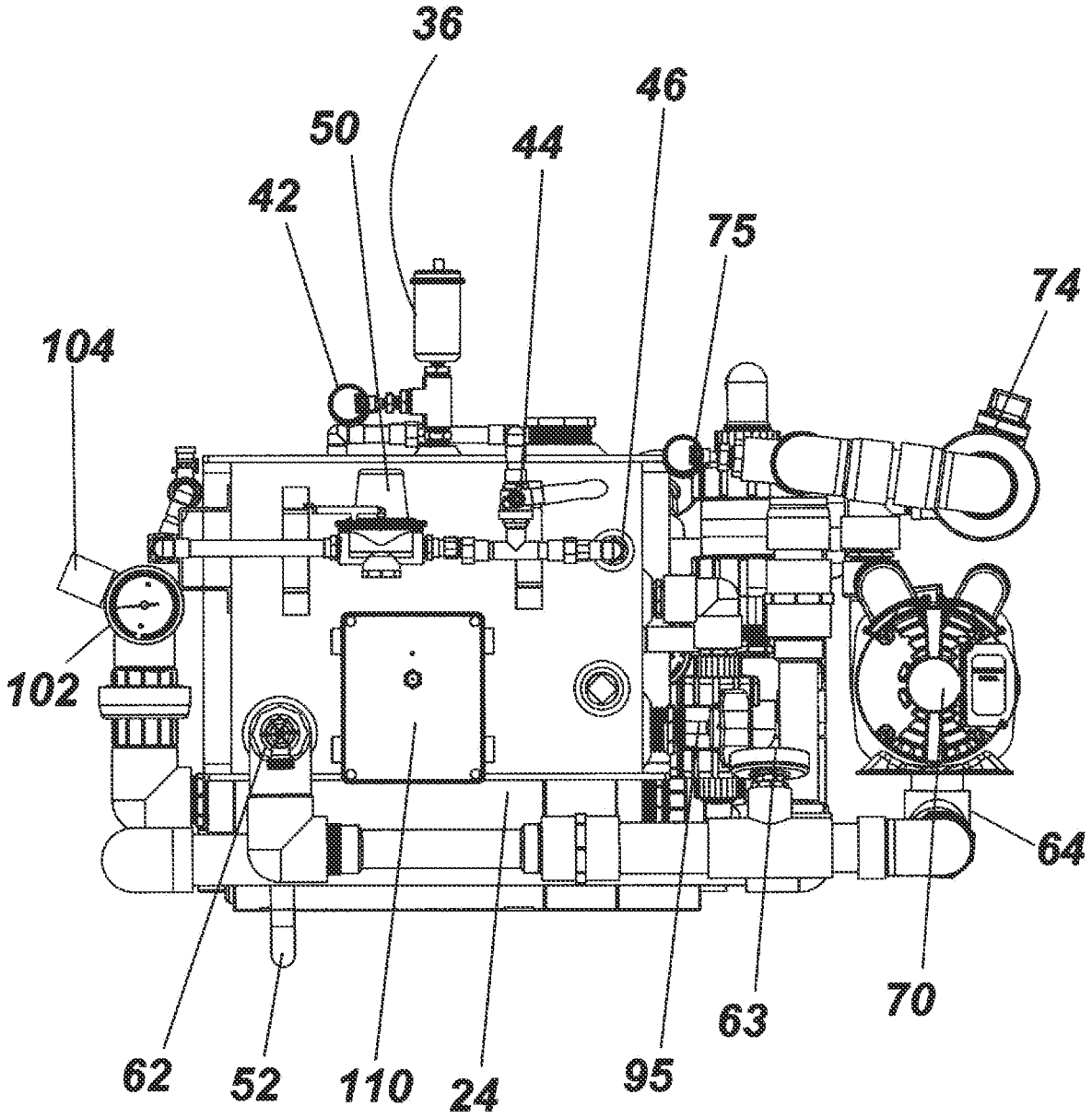
FIG. 4 is a front view thereof.
Figure 5:
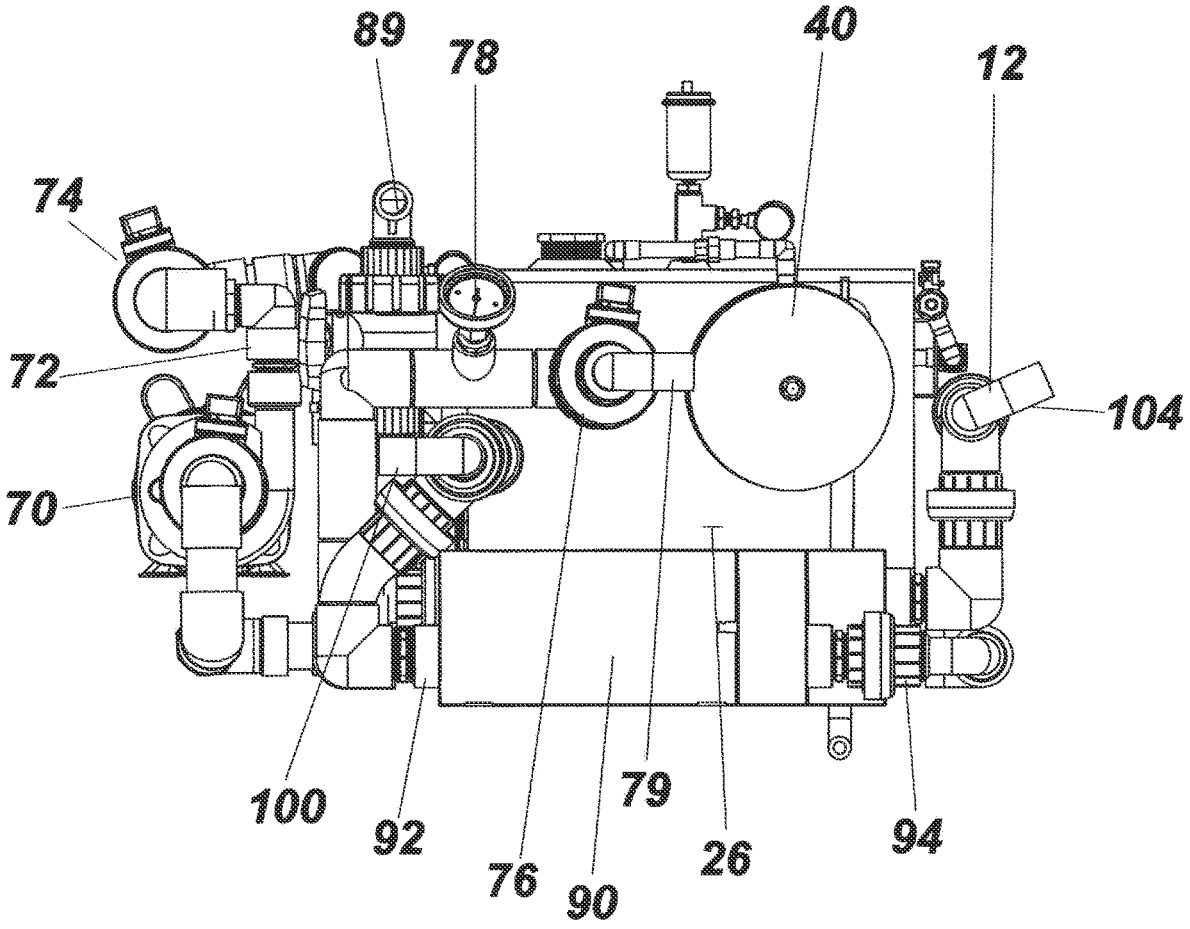
FIG. 5 is a rear side view thereof.
Figure 6:
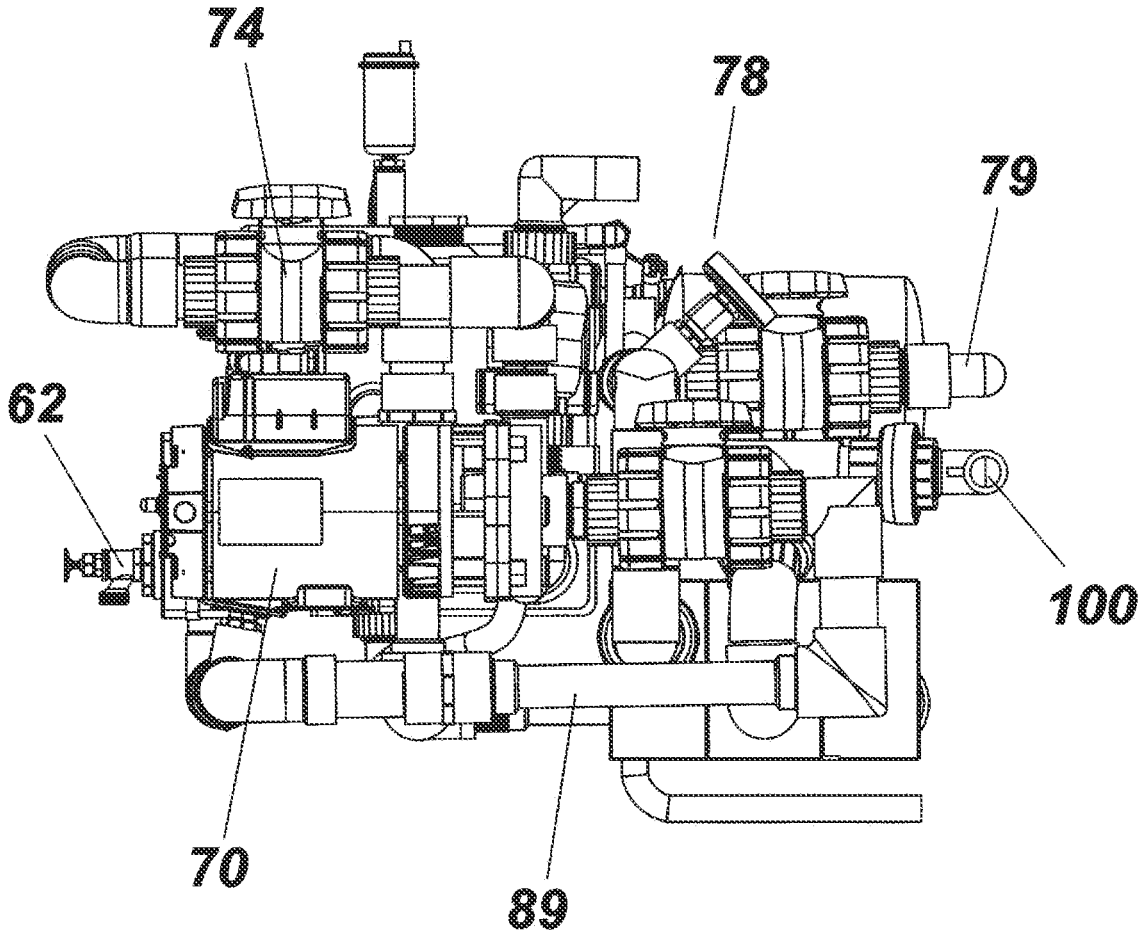
FIG. 6 is a right view thereof.
Figure 7:
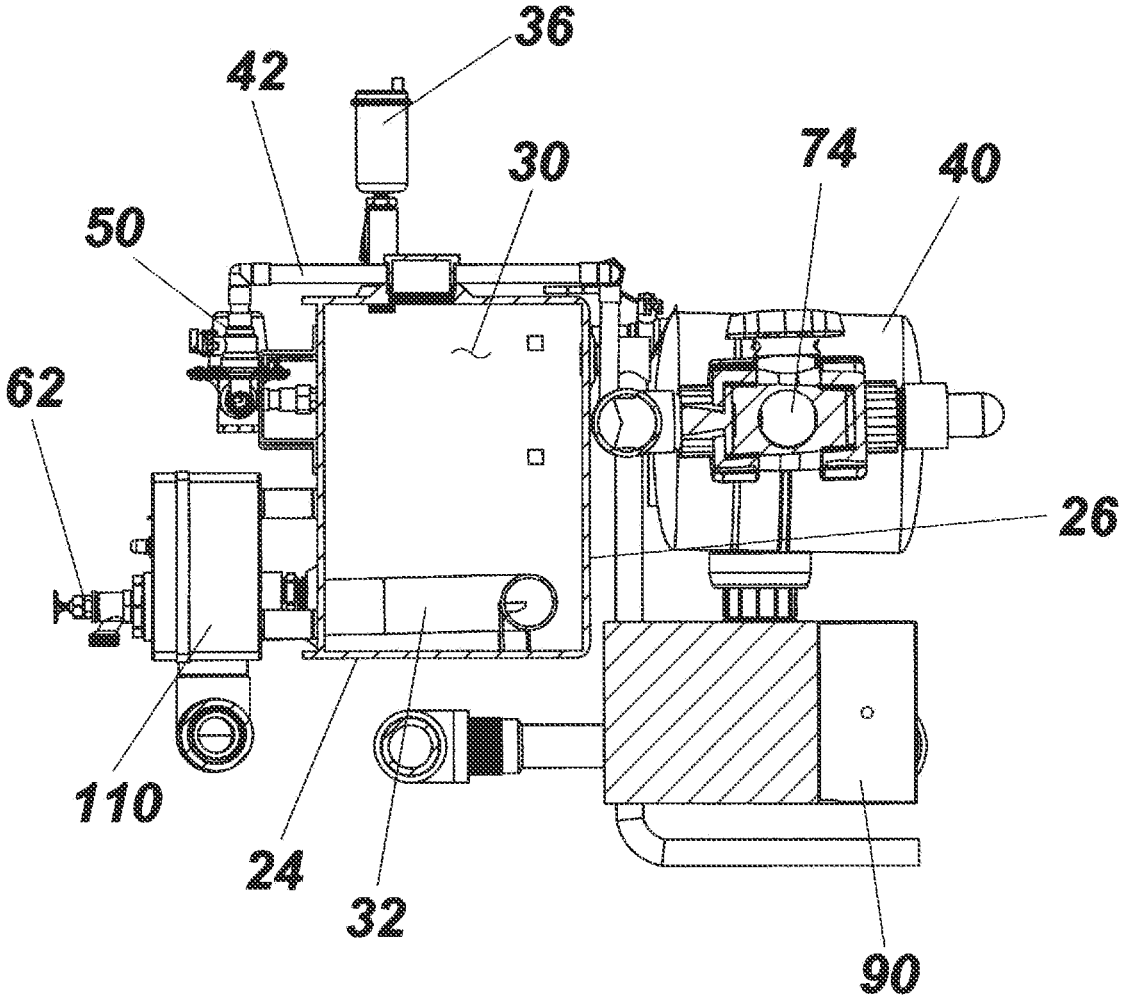
FIG. 7 is a cross sectional view taken along lines 7-7 of FIG. 2.
Figure 8:
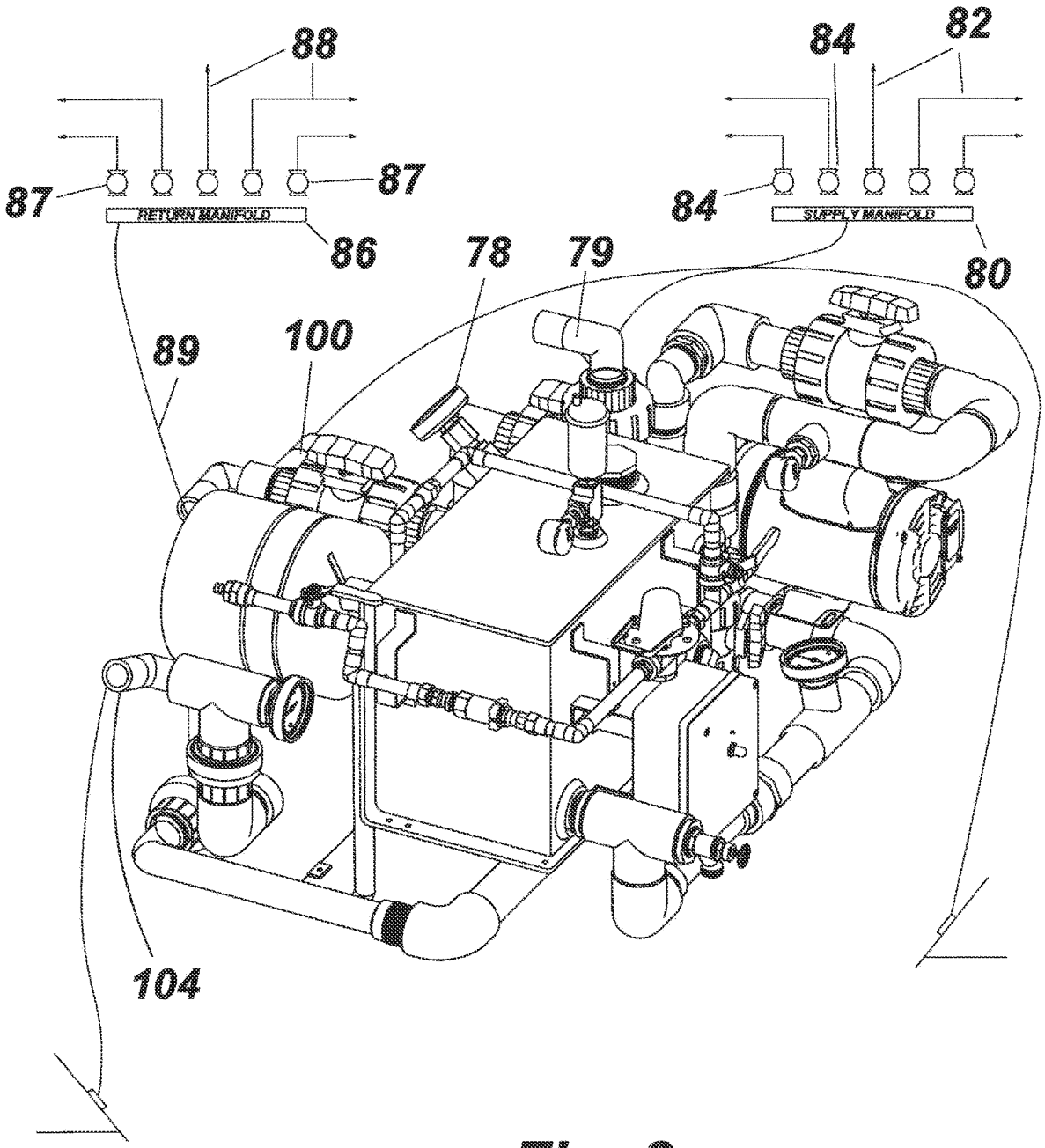
FIG. 8 is a pictorial piping diagram.

A detailed embodiment of the instant invention is disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to the figures in general, the raw water isolator apparatus 10 of the instant invention consists of a sealed fluid storage tank 12 having an internal volume sized to accommodate the amount of marine AC units or the like adjoining loop that will be maintained on a marine vessel. The storage tank 12 is defined by a left side wall 14, front wall 16, top wall 18, a right side wall 22, bottom wall 24, and rear wall 26 forming a chamber 30 therein. An interior flow control tubing 32 assures an air free suction.

A release nut 34 is threadingly attached to the top wall 18, providing access to the chamber 30 for the replacement of fluid when needed. In one embodiment, the fluid held within the chamber 30 is fresh water, or an admixture of fresh water and ethylene or propylene glycol, or an admixture including metal preservatives. Fresh water, defined as low total dissolved solids (TDS) represents the total concentration of dissolved substances in water. TDS of sea water can be about 35,000 mg/l, brackish water can be about 10,000 mg/l, fresh water is less than 300 mg/l. The higher the TDS the more quickly the corrosion and fouling can occur. An admixture made of fresh water, low TDS, has no corrosion or fouling tendencies.

Pressure relief valve 36 is fluidly coupled to the top wall 18 for release of excess pressure from a predetermined psi to protect the chamber 30 from excess pressurization. A pressure gauge 38 provides a visual indicator of chamber pressure. An expansion tank 40 is constructed and arranged to maintain a constant pressure in the chamber 30. The expansion tank 40 is fluidly coupled to the storage tank 12 by a transfer line 42 having a first shutoff valve 44 and entry into the case through inlet connection 46; the pressure in the transfer line 42 being adjustable through a pressure reducing valve 50, with a coupling line 52, providing a tank release of pressure to a thru-hull. The coupling line 52 has a shutoff valve 54 and a backflow preventer 56.

Fluid is drawn from the chamber 30 through the control tubing 32 from the inlet connection 46 to a suction pipe 60, a drain valve spigot 62 allowing fluid changes. The suction pipe 60 fluidly connects the control tubing 32 with an inlet 64 of a recirculation water pump 70. The temperature of the fluid is monitored by a thermostat 63. The water pump 70 is sized for recirculating the cooling fluid from the storage tank 12 through the AC units, chillers, ice makers, gyro stabilizers, and any other unit(s) that conventionally utilize raw water for cooling, which can be interconnected in a loop. The outlet 72 of the pump 70 has a first shutoff valve 74 with a pressure gauge 75 for pump 70 isolation, and a second shutoff valve 76 to isolate the apparatus 10 from a supply manifold 80. A thermostat 78 provides a visual check of the temperature of the fluid as it is delivered to the supply manifold 80. The loop supply manifold 80 is used for receipt of the cooling fluid from the delivery pipe 79; the supply manifold having individual feeder lines 82 to the AC units, not shown. Individual feeder lines 82 preferably include isolation valves 84. The fluid being supplied to the AC units exchange heat from the compressors, or the like unit mounted heat exchanger, and is collected in a return manifold 86, through return lines 88. Individual return lines 88 preferably include isolation valves 87. The isolation valves 84 and 87 are used to isolate a particular unit that may require individual servicing while the remaining units operate uninhibited. For instance, an AC unit with a failed condenser can be removed from the AC loop without affecting the operation of the remaining AC units. The return manifold 86 is coupled to a supply return connector 89.

Heat exchanger 90 receives heated fluid from the supply return connector 89, the heat exchanger having a parallel plate dividing the heated fluid from the raw water. The raw water will be used to cool the heated fluid. In a preferred embodiment, the heat exchanger 90 is welded parallel plate CP titanium heat exchanger having a cooled fluid outlet 94 fluidly coupled to transfer pipe 96 for returning the fluid to the chamber 30 through shut off valve 95.

For cooling of the recirculated fluid, a raw water (sea water) inlet 100 is fluidly coupled to a raw water transfer pump, not shown. The raw water is passed through a parallel plate in the heat exchanger 90 for heat transfer cooling of the recirculating fluid; the heat exchanger having a raw water outlet 104 with a thermostat 102 to verify proper operating ranges and effectiveness. The raw water is discharged from the heat exchanger through a discharge coupling 104.

Controller 110 can be as basic as an on/off switch for control of the motor, or include a programmable logic controller—PLC capable of monitoring functions such as pressure and temperature with preset alarm conditions, historical readings, temperature archive, hours of operation, and so forth. Further, manual shut-off valves can be automated and considered within the scope of this invention.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A raw water isolator apparatus comprising:

a storage tank forming a chamber therein for receipt of an admixture, said chamber having a chamber inlet and a chamber outlet;

an expansion tank fluidly coupled to said chamber, said expansion tank constructed and arranged to maintain a constant pressure in the chamber;

a pressure reducing valve positioned between said chamber and said expansion tank;

a backflow preventer positioned between said pressure reducing valve and said expansion tank;

a recirculation pump having a suction inlet fluidly coupled to said chamber outlet and a pump discharge outlet;

a supply manifold fluidly coupled to said pump discharge outlet, said supply manifold having individual lines fluidly coupled to inlets located on each system that requires cooling on a watercraft;

a supply return collector fluidly coupled to return of outlets located on each said system that requires cooling on a watercraft;

a heat exchanger having a parallel plate with a first side for passing the admixture from the supply return collector to said chamber, and a second side for passing raw water; and a transfer pump directing raw water through said second side of said heat exchanger providing heat transfer cooling of said admixture as the raw water is discharged.

2. The raw water isolator apparatus according to claim 1 including a first shutoff valve positioned between said chamber and said expansion tank.

3. The raw water isolator apparatus according to claim 1 including a pressure relief valve secured to said storage tank.

4. The raw water isolator apparatus according to claim 1 wherein said admixture is low total dissolved solids water.

5. The raw water isolator apparatus according to claim 4 wherein said admixture includes ethylene glycol or propylene glycol.

6. The raw water isolator apparatus according to claim 4 wherein said admixture includes a metal preservative.

7. The raw water isolator apparatus according to claim 1 including a pressure relief valve secured to said chamber.

8. The raw water isolator apparatus according to claim 1 including a thermostat secured to said chamber for monitoring temperature of said admixture.

9. The raw water isolator apparatus according to claim 1 including an isolator valve on each said individual line from said supply manifold.

10. The raw water isolator apparatus according to claim 1 wherein said heat exchanger includes a commercial pure titanium plate with a cooled fluid outlet.

11. The raw water isolator apparatus according to claim 1 including a controller for monitoring predetermined functions.

12. The raw water isolator apparatus according to claim 1 including a fill line coupling a fresh water source with said chamber, said fill line comprising a back flow preventer and a pressure reducing valve.

* * * * *